US010213784B1

(12) United States Patent
Hagan et al.

(10) Patent No.: US 10,213,784 B1
(45) Date of Patent: Feb. 26, 2019

(54) INERTION FUNNEL

(71) Applicant: Merck Sharp & Dohme Corp., Rahway, NJ (US)

(72) Inventors: Matthew Franklin Hagan, North Plainfield, NJ (US); Mark Dennis Weisel, Stewartsville, NJ (US)

(73) Assignee: Merck Sharp & Dohme Corp., Rahway, NJ (US)

( * ) Notice: Subject to any disclaimer, the term of this patent is extended or adjusted under 35 U.S.C. 154(b) by 0 days.

(21) Appl. No.: 16/105,677

(22) Filed: Aug. 20, 2018

(51) Int. Cl.
*B01L 3/00* (2006.01)
*B01L 5/00* (2006.01)

(52) U.S. Cl.
CPC ..... *B01L 5/00* (2013.01); *B01L 2200/025* (2013.01); *B01L 2200/0605* (2013.01); *B01L 2200/082* (2013.01); *B01L 2300/12* (2013.01)

(58) Field of Classification Search
CPC ..... B01L 5/00; B01L 2200/0605; B01L 2200/025; B01L 2200/082; B01L 2300/12
See application file for complete search history.

(56) References Cited

U.S. PATENT DOCUMENTS

2014/0202967 A1* 7/2014 Olivier ..... G01N 1/4077 210/808

* cited by examiner

*Primary Examiner* — Dennis White
(74) *Attorney, Agent, or Firm* — Fenwick & West LLP

(57) ABSTRACT

An inertion funnel includes a hollow ring with an attachment point on an outside edge and a plurality of output apertures on the inside edge allows for an even flow of gas around the circumference of the ring and through the output apertures into a filter funnel below. The attachment point allows the attachment of a hose or other fitting through which gas flows into the hollow ring, which rests above and around the opening of the filter funnel. On the inside of the ring, an angled downward opening allows gas to flow out of the ring and into the filter funnel. Uniformly distributed around the opening are vanes that direct the flow of gas from the ring into the filter funnel below.

12 Claims, 3 Drawing Sheets

INERTION FUNNEL

TECHNICAL FIELD

The subject matter described herein generally relates to chemical analysis instruments, and more specifically, to an inertion funnel having a hollow ring with an attachment point for insertion of inert gas and a downward opening to a filter funnel.

BACKGROUND

Many chemical analysis procedures involve the mixture of chemicals in titration devices or other vessels. Often, it is necessary to keep certain gases out of the vessel in which the experiment occurs to ensure that the experiment works properly or to prevent unintended, and sometimes dangerous, results, such as a fire or an explosion. For example, in an experiment involving separation of a solvent and a metal catalyst, removing all of the solvent from the catalyst may expose the catalyst to oxygen in the air. This can cause the catalyst to oxidize and heat up, potentially causing issues such as hazards, e.g., a fire.

BRIEF DESCRIPTION OF THE DRAWINGS

The disclosed embodiments have advantages and features which will be more readily apparent from the following detailed description and the appended claims, when taken in conjunction with the accompanying drawings, in which:

DETAILED DESCRIPTION

The figures and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

An inertion funnel may rest on top of a filter funnel and reduce the concentration of oxygen in the filter funnel to below the level at which oxidation of a metal catalyst would occur while still providing access to the filter funnel to minimize disruption of existing procedures. Nitrogen or other inert gas flowing through the inertion funnel displaces the oxygen in the filter funnel. An even flow of gas is achieved flowing down into the filter funnel from around the circumference of the filter funnel opening.

Figure 1:
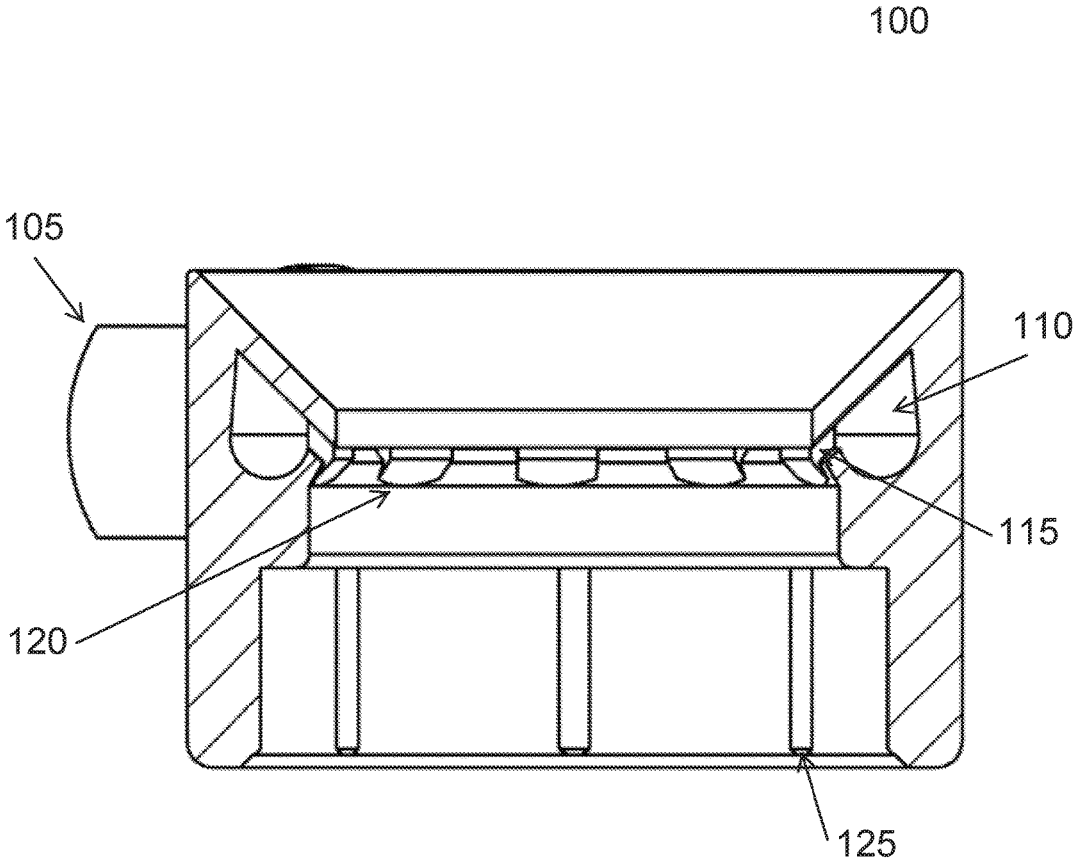
FIG. 1 illustrates a cross-sectional view of an inertion funnel, according to an example embodiment.

Referring now to FIG. 1, it illustrates one example embodiment of an inertion funnel 100. FIG. 1 illustrates a cross-sectional view of the inertion funnel 100 taken along the lines 3-3 of FIG. 3. In the embodiment shown, the inertion funnel 100 includes a connection point 105 structured to allow the attachment to the inertion funnel 100 of a fitting or hose through which inert gas flows into the inertion funnel 100, a hollow ring 110 connected to the connection point 105 and structured to allow for the flow of gas around the ring 110, and an opening 115 on the inside of the ring 110 structured to allow gas to flow out of the ring 110 and into a filter funnel below the inertion funnel 100. The inertion funnel 100 also includes a plurality of vanes 120 distributed around the opening 115 and structured to direct the flow of gas into the filter funnel, a notch around the bottom of the ring 110 structured to allow the inertion funnel 100 to rest on top of a filter funnel, and, optionally, a funnel grip 125 structured to aid in the retention of the filter funnel inside the inertion funnel 100.

The inertion funnel 100 may be made of nylon, acrylonitrile butadiene styrene (ABS) plastic, thermoplastic polymer (such as polyethylene, polypropylene, or polytetrafluoroethylene), or another rigid material and may be manufactured using injection molding, panel forming, blow molding, thermoforming, 3D printing, or the like. The inertion funnel 100 may be constructed in a single piece or in multiple pieces. For example, in one example embodiment, a body of the inertion funnel 100 is constructed separate from the connection point 105. In another example embodiment, the inertion funnel 100 is constructed in multiple pieces and assembled to form the inertion funnel 100. In one such instance, the inertion funnel 100 is vacuum molded as two separate, symmetrical pieces that are then bonded together (e.g., by pressing the two pieces together while the material is still hot).

In one example embodiment, the height of the inertion funnel 100 is approximately 20-100 millimeters. The diameter of the exterior of the ring 110 is approximately 40-150 millimeters, and the diameter of the interior of the ring 110 is approximately 10-120 millimeters. The diameter of the connection point 105 is approximately 15-70 millimeters at the exterior of the connection point 105 and approximately 10-50 millimeters in the interior of the connection point 105. The length of each vane 120 is approximately 4-20 millimeters and the width of each vane is approximately 1-10 millimeters. In other embodiments, the dimensions of the various portions of the inertion funnel 100 may be different.

The connection point 105 is connected to the ring 110 at a first point along the circumference of the ring 110. In one example embodiment, the connection point 105 is hollow for engagement with a fitting or hose through which gas may travel through the connection point 105 into the ring 110. The wall of the connection point 105 is approximately 1-10 millimeters thick, such that the exterior wall of the connection point 105 is approximately 15-70 millimeters in diameter, and the interior wall of the connection point 105 is approximately 10-50 millimeters in diameter. In one example embodiment, the connection point 105 has a smooth exterior wall and an interior wall with a screw thread protruding outward from the interior wall for engagement with a reciprocal screw thread on a separate fitting or hose.

The ring 110 allows for the free flowing of gas around the ring 110 to achieve a more uniform pressure with minimal pressure drop from the areas of the ring 110 near the connection point 105 to the areas of the ring 110 opposite the connection point 105. The ring 110 has an outer wall and an inner wall. In one example embodiment, the inner wall has a top end with a diameter of approximately 40-150 millimeters and a bottom end with a diameter of approximately 10-120 millimeters such that the inner wall slopes inward from the top end to the bottom end. In one embodiment, the diameter difference between the top end of the inner wall and the bottom end of the inner wall is approximately 30 millimeters, although the range of diameters may vary in other embodiments. The bottom end forms a downward opening structured to allow the flow of gas from around the circumference of the ring 110 through the downward opening 115 into the filter funnel below. The ring 110 is connected to the connection point 105 at a first point along an exterior wall of the ring 110, and also includes a notch around the bottom of the ring 110 to allow the inertion funnel 100 to sit on top of the filter funnel.

In one example embodiment, a top surface of the ring 110 is angled downward at an approximately 45-degree angle from the top of the ring 110 to a first point along the height of the inertion funnel 100 approximately 3-15 millimeters from the top of the ring 110 to decrease the likelihood of the contents of the filter funnel spilling out of the top of the inertion funnel 100. In other embodiments, the top of the ring 110 may be angled downward at different angles.

The vanes 120 are distributed equidistantly around the opening 115 on the inside edge of the ring 110. In one example embodiment, the vanes 120 are output apertures to a cavity formed between the inner wall and the outer wall and that restrict and direct the flow of the gas from the ring 110 into the filter funnel below. In one example embodiment, the inertion funnel 100 includes ten vanes 120 spaced approximately 5-20 millimeters apart, but more or fewer vanes 120 may be used in other embodiments. The output apertures may be approximately 4-20 millimeters long and approximately 1-10 millimeters wide. The vanes 120 aid in keeping the gas non-turbulent, or laminar. The laminar flow reduces the mixing of the air with the gas being used to inert the filter funnel, allowing for a lower flowrate of inert gas to be used to lower the oxygen concentration more quickly.

Figure 2:
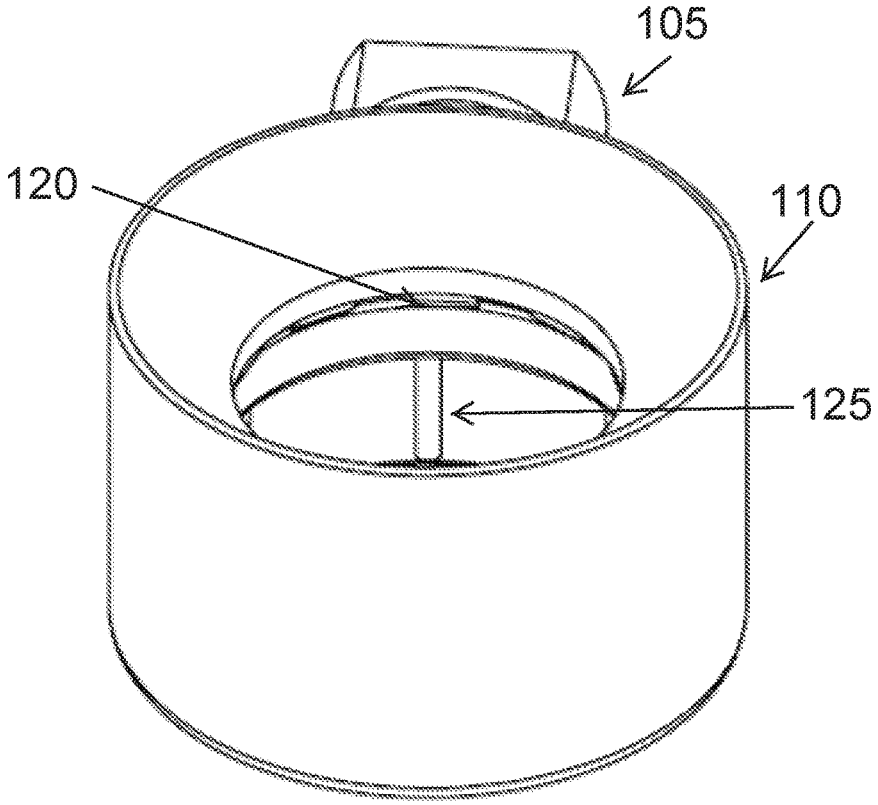
FIG. 2 illustrates a top and front perspective view of an inertion funnel, according to an example embodiment.

FIG. 2 illustrates a top and front perspective view of an inertion funnel 100, according to an example embodiment. In the example embodiment shown in FIG. 2, the inertion funnel 100 includes a threaded connection point 105 attached to the exterior wall of the inertion funnel 100 to allow the attachment of a fitting or hose through which nitrogen or other inert gas may flow into the ring 110. The inertion funnel 100 also includes a plurality of vanes 120 distributed equidistantly around an opening 115 on the inside of the ring 110 and a notch around the bottom of the ring 110 to allow the inertion funnel 100 to sit securely on top of a filter funnel. In the example embodiment shown in FIG. 2, a top surface of the ring 110 is angled downward at an approximately 45-degree angle from the top of the ring 110 for approximately 7-30 millimeters.

Figure 3:
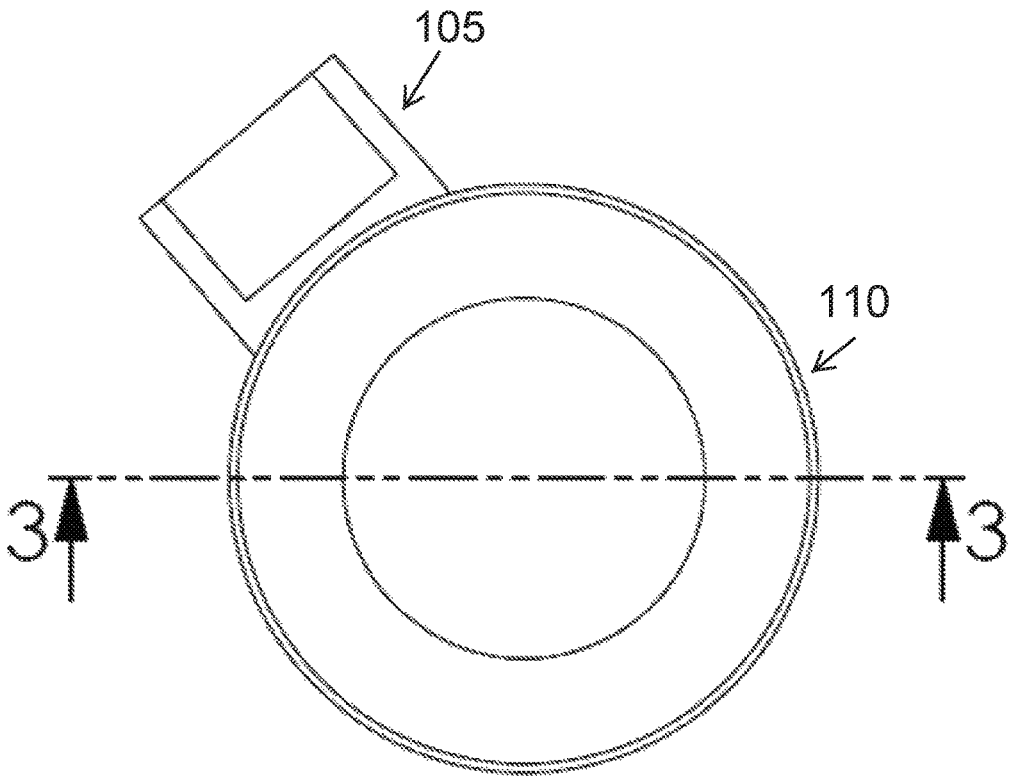
FIG. 3 illustrates a top view of an inertion funnel, according to an example embodiment.

FIG. 3 illustrates a top view of an inertion funnel 100, according to an example embodiment. In the embodiment shown in FIG. 3, the inertion funnel 100 includes a ring 110 with a diameter of approximately 40-150 at the exterior of the ring 110 and approximately 10-120 millimeters in the interior of the ring 110. The inertion funnel 100 also includes a connection point 105 attached to the exterior wall of the inertion funnel 100 to allow the flow of nitrogen or gas into the ring 110.

Additional Configuration Considerations

The disclosed configurations provide advantages over existing chemical analysis instruments. For example, notches around the bottom of the ring allow the ring to rest securely atop the filter funnel and permitting the free flowing of gas above and around the filter funnel's opening. The distribution of the vanes around the circumference of the ring restrict and direct the flow of the gas from the ring into the filter funnel such that an even flow of gas is able to displace the oxygen in the filter funnel to reduce oxygen levels to below the level at which oxidation of the catalyst would occur.

As used herein, the terms "comprises," "comprising," "includes," "including," "has," "having," or any other variations thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs as disclosed from the principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. An inertion funnel comprising:

a hollow ring having an outer wall and an inner wall, the inner wall having a top end and a bottom end, the top end having a larger diameter than the bottom end and the wall sloping from the top end to the bottom end to create an inner opening, the bottom end forming a downward opening structured to allow a flow of gas around a circumference of the hollow ring and through the downward opening;

a connection point having a cylindrical wall with a first end and a second end, the first end of the cylindrical wall having an opening on the outer wall and the second end of the cylindrical wall having an opening structured to receive a hose input, the connection point structured to allow introduction of gas through the hose input into a cavity formed between the inner wall and the outer wall; and a plurality of output apertures to the cavity formed between the inner wall and the outer wall and distributed around the inner wall of the hollow ring, the output apertures structured to direct the flow of gas from the inner wall of the hollow ring to a vessel below the downward opening of the inertion funnel.

2. The inertion funnel of claim 1, further comprising a notch around a circumference of the bottom end of the hollow ring.

3. The inertion funnel of claim 1, wherein the connection point includes a screw thread having a plurality of turns on an interior wall of the connection point.

4. The inertion funnel of claim 1, wherein the inertion funnel is comprised of nylon, acrylonitrile butadiene styrene plastic, thermoplastic polymer, or other rigid material.

5. The inertion funnel of claim 1, wherein the inertion funnel is a unibody construction.

6. The inertion funnel of claim 1, wherein a height of the inertion funnel is approximately 20-100 millimeters.

7. The inertion funnel of claim 1, wherein a diameter of the bottom end of the inner wall of the hollow ring is approximately 10-120 millimeters and a diameter of the outer wall of the hollow ring is approximately 40-150 millimeters.

8. The inertion funnel of claim 1, wherein the inertion funnel includes approximately ten output apertures.

9. The inertion funnel of claim 1, wherein the downward opening is angled downward at approximately 45 degrees.

10. The inertion funnel of claim 1, wherein the output apertures are approximately 4-20 millimeters long.

11. The inertion funnel of claim 1, wherein the output apertures are approximately 1-10 millimeters wide.

12. The inertion funnel of claim 1, wherein a top surface of the hollow ring is angled downward at approximately 45 degrees.

* * * * *